US005294525A

United States Patent [19]

Yamauchi et al.

[11] Patent Number: 5,294,525

[45] Date of Patent: Mar. 15, 1994

[54] SILVER HALIDE PHOTOGRAPHIC LIGHT-SENSITIVE MATERIAL CAPABLE OF MAGNETIC-RECORDING

[75] Inventors: Yasuhisa Yamauchi; Yoshitaka Yasufuku; Eiichi Ueda, all of Hino, Japan

[73] Assignee: Konica Corporation, Japan

[21] Appl. No.: 871,954

[22] Filed: Apr. 21, 1992

[30] Foreign Application Priority Data

Apr. 30, 1991 [JP] Japan ..... 3-99015

[51] Int. Cl.[5] ..... G03C 1/76; G03C 1/85

[52] U.S. Cl. ..... 430/523; 430/530; 430/501; 428/692; 428/694 B; 428/694 BG

[58] Field of Search ..... 430/530, 523, 501; 428/692, 694

[56] References Cited

U.S. PATENT DOCUMENTS

| | | | |
|---|---|---|---|
| 4,279,945 | 7/1981 | Audran et al. | 430/495 |
| 4,283,476 | 8/1981 | Farnsworth et al. | 430/140 |
| 4,302,523 | 11/1981 | Audran et al. | 430/524 |
| 4,418,141 | 11/1983 | Kawaguchi et al. | 430/530 |
| 4,495,276 | 1/1985 | Takimoto et al. | 430/527 |
| 5,147,768 | 9/1992 | Sakakibara | 430/501 |
| 5,215,874 | 6/1993 | Sakakibara | 430/501 |
| 5,227,283 | 7/1993 | Mori | 430/523 |
| 5,229,259 | 7/1993 | Yokota | 430/523 |
| 5,238,794 | 8/1993 | Hirose et al. | 430/496 |

FOREIGN PATENT DOCUMENTS

| | | |
|---|---|---|
| 2382325 | 9/1978 | France . |
| 2075208 | 11/1981 | United Kingdom . |

*Primary Examiner*—Charles L. Bowers, Jr.
*Assistant Examiner*—Mark F. Huff
*Attorney, Agent, or Firm*—Jordan B. Bierman

[57] ABSTRACT

Disclosed is a silver halide photographic light-sensitive material comprising;

a support having a first side and a second side which is opposite to said first side;

a silver halide emulsion layer provided on said first side: and a recording medium provided on said second side, wherein said recording medium comprising a magnetic layer having a magnetic powder and a first binder, and a conductive layer which contains a conductive particle and a second binder, said conductive particle being essentially consisting of one of crystalline metal oxide selected from the group consisting of ZnO, $TiO_2$, $SnO_2$, $Al_2O_3$, $In_2O_3$ and $SiO_2$, and a complex oxide thereof.

A silver halide photographic light sensitive material according to this invention is capable of magnetic recording, high in light transmitting property, and excellent in antistatic property and film feeding property.

9 Claims, No Drawings

SILVER HALIDE PHOTOGRAPHIC LIGHT-SENSITIVE MATERIAL CAPABLE OF MAGNETIC-RECORDING

FIELD OF THE INVENTION

The present invention relates to a silver halide photographic light-sensitive material, particularly to a silver halide photographic light-sensitive material capable of magnetic-recording and excellent in antistatic property and feeding property.

BACKGROUND OF THE INVENTION

U.S. Pat. No. 4,947,196 and International Patent Publication No. 90/04254 disclose a roll of photographic film having, on the backside of the film, a magnetic layer containing a magnetic substance for magnetic recording, as well as a photographic camera having a built-in magnetic head. This advanced technique makes possible to improve the quality of prints and the efficiency of printing work by allowing the magnetic layer to input or output information to identify the light-sensitive material and the manufacturer thereof, information on the photographing conditions, information on the printing conditions and information on the additional printing.

In general, a magnetic layer is poor in antistatic property and feeding property because it has no conductivity by itself and possesses a high coefficient of friction. In order to solve such problems, a fatty acid or a fatty acid ester, and/or an antistatic agent, is added to an ordinary magnetic tape. As the antistatic agent, carbon black is usually used in a manner to add a large amount of it in a magnetic layer or to coat a layer comprised of it on the backside of a magnetic layer.

For a photographic film having a magnetic layer on the backside, however, carbon black cannot be used as a tool to prevent static electrification and lower the coefficient of friction, because positive and negative silver halide photographic light-sensitive films require an excellent light transmitting property from their uses.

OBJECT OF THE INVENTION

The object of the present invention is to provide a silver halide photographic light-sensitive material capable of magnetic-recording, high in light transmitting property, and excellent in antistatic property and film feeding property.

CONSTITUTION OF THE INVENTION

The above object of the invention is attained by a silver halide photographic light-sensitive material comprising:

a support having a first side and a second side which is opposite to said first side;

a silver halide emulsion layer provided on said first side; and a recording medium provided on said second side, wherein said recording medium comprises a magnetic layer having a magnetic powder and a first binder, and a conductive layer which contains a conductive particle and a second binder, said conductive particle being essentially consisting of one of crystalline metal oxide selected from the group consisting of ZnO, $TiO_2$, $SnO_2$, $Al_2O_3$, $InO_3$ and $SiO_2$, and a complex oxide thereof.

In the preferable embodiment of the invention, at least one of binders respectively contained in the non-magnetic layer and the magnetic layer has a polar functional group such as a sulfo group or a phosphoric group.

The present invention is hereunder described in detail.

In the invention, either the magnetic layer or the non-magnetic conductive layer may form the uppermost layer.

The metal oxide particles used in the non-magnetic conductive layer include, for example, a colloid of stannic oxide described in Japanese Pat. Exam. Pub. No. 616/1960 and metal oxides described in Japanese Pat. O.P.I. Pub. Nos. 5300/1976, 12927/1980 and 143431/1981. Preferable metal oxides are crystalline ones in view of their antistatic property. Particularly preferable ones are metal oxides containing oxygen defects as well as metal oxides containing a small amount of foreign atoms which act as doners to those metal oxides, because these have a high conductivity in general. And the latter ones are the most suitable for their incapability of fogging a silver halide emulsion. Examples of preferable metal oxides include ZnO, $TiO_2$, $SnO_2$, $Al_2O_3$, $In_2O_3$, $SiO_2$ and a complex of these metal oxides. Among them, ZnO, $TiO_2$ and $SnO_2$ are particularly preferred. There is available ITO (indium.-tin oxide:$(In_2O_3)_x(SnO_2)_y$) as a preferable complex oxide. As examples of foreign-atom-containing metal oxides, addition of Al or In to ZnO, that of Sb, Nb or halogen atoms to $SnO_2$ and that of Nb or Ta to $TiO_2$ are effective. The addition amount of these foreign atoms is 0.01 to 30 mole %, preferably 0.1 to 10 mole % for metal oxides.

The size of these conductive particles is usually not more than 10 μm; a particle size less than 2 μm can give a stable dispersion which is easy to handle. And use of conductive particles of which sizes are 0.5 μm or less is particularly preferred in order to form a transparent light-sensitive materials by reducing the scattering of light as much as possible.

The conductive layer according to the invention may employ the same binder as is used in the magnetic layer.

It is preferable for the binder (resin) used in the invention to be a modified resin having a polar group selected from $—SO_3M$, $—OSO_3M$ and $—P(=O)(OM_1)(OM_2)$ (where, M is a hydrogen, sodium, potasium or lithium atom; $M_1$ and $M_2$ may be the same with or different from each other and each represent a hydrogen, sodium, potasium or lithium atom, or an alkyl group). But the above polar groups may not be necessarily present in the binder resin.

Suitable binder resins are, for example, polyvinyl chloride type resins, polyurethane resins, polyester resins and polyethylene type resins.

These resins can be modified by various methods. For example, a metal-sulfonate-group-containing polyester resin can be obtained by employing a metal-sulfonate-group-containing dicarboxylic acid as a portion of the dicarboxylic acid component and allowing this and a dicarboxylic acid having no metal sulfonate group to undergo condensation with a diol.

A metal-sulfonate-group-containing polyester polyurethane resin can be prepared by the condensation reaction and addition reaction using a diisocyanate and three compounds comprised of a metal-sulfonate-group-containing dicarboxylic acid used as a starting material of the above metal-sulfonate-group-containing polyester, a dicarboxylic acid containing no metal sulfonate group, and a diol. In the case of a polyurethane resin, a desired urethane resin can be synthesized, for example, by introducing a metal sulfonate group into a diol.

Further, such a polar group can also be introduced by modifying a polyester resin, polyurethane resin or polyvinyl chloride type resin. That is, the polar group is introduced into these resins by subjecting these resins and a compound having the polar group and a chlorine atom in the molecule, such as $ClCH_2CH_2SO_3M$, $ClCH_2CH_2OSO_3M$ or $ClCH_2P(=O)(OM_1)(OM_2)$(M,$M_1$ and $M_2$ are the same as defined above), to dehydrochlorination.

The carboxylic acid component used to prepare these polyester resins and polyurethane resins includes, for example, aromatic dicarboxylic acids such as terephthalic acid, isophthalic acid, orthophthalic acid, 1,5-naphthalic acid; aromatic oxycarboxylic acids such as p-(hydroxyethoxy)benzoic acid; aliphatic dicarboxylic acids such as succinic acid, adipic acid, azelaic acid, sebacic acid, dodecanedicarboxylic acid; and tri- and tetra-carboxylic acids such as trimellitic acid, trimesic acid, pyromellitic acid. Among them, terephthalic acid, isophthalic acid, adipic acid and sebacic acid are preferred.

The metal-sulfonate-group-containing dicarboxylic acid component includes, for example, 5-sodium sulfoisophthalic acid, 5-potassium sulfoisophthalic acid, 2-sodium sulfoterephthalic acid and 2-potassium sulfoterephthalic acid.

The diol component includes, for example, ethylene glycol, propylene glycol, 1,3-propanediol, 1,4-butanediol, 1,5-pentanediol, 1,6-hexanediol, neopentyl glycol, ethylene glycol, dipropylene glycol, 2,2,4-trimethyl-1,3-neopentanediol, 1,4-cyclohexanedimethanol, ethylene oxide adducts of bisphenol A, ethylene oxide adducts of hydrogenated bisphenol A, polyethylene glycols, polypropylene glycols and polytetramethylene glycols. Further, there can be jointly used triols and/or tetraols such as trimethylol ethane, trimethylol propane, glycerol and pentaerythritol.

The isocyanate component used to prepare the polyurethane resin includes, for example, 2,4-tolylenediisocyanate, 2,6-tolylenediisocyanate, p-phenylenediisocyanate, m-phenylenediisocyanate, 3,3'-dimethoxy-4,4'-biphenylenediisocyanate, 4,4'-diisocyanate diphenyl ether, 1,3-naphthalenediisocyanate, p-xylidenediisocyanate, m-xylidenediisocyanate, methylcyclohexane 1,3-diisocyanate, 1,4-methylcyclohexanediisocyanate, 4,4'-diisocyanate dicyclohexane, 4,4'-diisocyanate dicyclohexyl methane and isophronediisocyanate.

In the invention, it is preferable that the binder resin in the conductive layer and that in the magnetic layer be a combination of a urethane resin and a polyvinyl chloride type resin, and that both of these resins be modified.

The addition amount of the conductive particles is not more than 15 mg, preferably not more than 7 mg and especially 0.5 to 4 mg per 100 $cm^2$ in terms of metal oxide.

In order to raise the conductivity of the conductive layer, it is preferable that the volumetric content of conductive particles be higher as much as possible. But, to secure a transparency required of the conductive layer, the weight ratio of binder to metal oxide is preferably 5:1 to 1:5 and especially 5:1 to 1:2.

It is preferable that a conductive layer in the present invention is transparent. Optical density of 1.0 or less is preferable, that of 0.75 or less is more preferable and that ranging from 0.02 to 0.3 is especially preferable. Incidentally, with regard to a magnetic-recording layer (including a magnetic layer and a conductive layer) in the invention, optical density of 1.0 or less is preferable, that of 0.75 or less is more preferable and that ranging from 0.02 to 0.3 is especially preferable. In order to obtain the aforementioned optical density, it is necessary to adjust coating weight by changing the ratio of magnetic powder and conductive particles to binder and coating thickness.

Next, the magnetic layer is described.

It is preferable that the magnetic layer in the invention be transparent. Its optical density is usually not more than 1.0, preferably not more than 0.75 and especially 0.02 to 0.3.

In the invention, the magnetic layer is a layer comprised of a ferromagnetic powder dispersed in a binder. The coating weight of the magnetic powder is not more than 10 mg, preferably not more than 5 mg and especially 0.1 to 3 mg per 100 $cm^2$ as an amount of iron present.

As the ferromagnetic powder, there can be used, for example, $\gamma$-$Fe_2O_3$ powder, Co-coated $\gamma$-$Fe_2O_3$ powder, Co-coated $\gamma$-$Fe_3O_4$ powder, Co-coated FeOx ($4/3<x<3/2$) powder, other Co-containing iron oxides and other ferrites, for example, hexagonal ferrites including M and W types of Ba ferrite, Sr ferrite, Pb ferrite, Ca ferrite and their solid solutions and ion substitution products.

As a hexagonal ferrite magnetic powder, there can be used an element having a coercive force of 200 to 2,000 Oe in which Fe atoms, a component element of these uniaxial anisotropic hexagonal ferrite crystals, are partially displaced by a divalent metal; at least one pentavalent metal selected from Nb, Sb and Ta; and Sn atom within the range from 0.05 to 0.5 atom per chemical formula.

Preferable divalent metals in these hexagonal ferrites are Mn, Cu and Mg, which have high capabilities of displacing Fe atoms contained in the ferrites.

In these hexagonal ferrites, the appropriate displacement amount by a divalent metal (MII) and a pentavalent metal (MV) varies with the combination of MII and MV, but it is preferably 0.5 to 1.5 atom per chemical formula of MII.

When the relation between displacing elements and their displacement amounts is examined taking a magnetoplumbite type Ba ferrite as an example, the chemical formula of the displacement product is expressed as follows:

$$BaFe_{12-(x+y+z)}MII_xMV_ySn_zO_{19}$$

wherein x, y and z represent respective displacement amounts of MII, MV and Sn atom per chemical formula. MII, MV and Sn are divalent, pentavalent and tetravent, respectively, and Fe atoms to be displaced are trivalent. Accordingly, the relation of $y=(x-z)/2$ is valid when the value compensation is taken into consideration. That is, the displacement amount by MV is unequivocally decided from the displacement amounts of MII and Sn. The coercive force (Hc) of the above ferromagnetic powder is usually not less than 200 Oe, preferably not less than 300 Oe.

The size of the magnetic powder is preferably not more than 0.3 $\mu$m, especially not more than 0.2 $\mu$m, in the longitudinal direction.

The specific surface area of the ferromagnetic powder measured by the BET method is usually not less than 20 $m^2/g$, preferably 25 to 80 $m^2/g$.

The shape of these ferromagnetic powder is not particularly limited, and any of needles, spheres and ovals can be employed.

The magnetic layer according to the invention may contain a fatty acid.

Such a fatty acid may be either monobasic or dibasic, and the number of carbon atoms contained in the fatty acid is preferably 6 to 30, especially 12 to 22.

Examples of suitable fatty acids include caproic acid, caprylic acid, capric acid, lauric acid, myristic acid, palmitic acid, stearic acid, isostearic acid, linolenic acid, linolic acid, oleic acid, elaidic acid, behenic acid, malonic acid, succinic acid, maleic acid, glutaric acid, adipic acid, pimelic acid, azelaic acid, sebacic acid, 1-12 dodecanedicarboxylic acid and octanedicarboxylic acid.

Among them, myristic acid, oleic acid and stearic acid are particularly preferred.

Further, adding a fatty acid ester to the magnetic layer reduces the coefficient of friction of the magnetic layer, and thereby much more improves the running property and durability of the magnetic recording medium of the invention.

Examples of such fatty acid esters include oleyl oleate, oleyl stearate, isocetyl stearate, dioleyl maleate, butyl stearate, butyl palmitate, butyl myristate, octyl myristate, octyl palmitate, amyl stearate, amyl palmitate, stearyl stearate, lauryl oleate, octyl oleate, isobutyl oleate, ethyl oleate, isotridecyl oleate, 2-ethylhexyl stearate, 2-ethylhexyl myristate, ethyl stearate, 2-ethylhexyl palmitate, isopropyl palmitate, isopropyl myristate, butyl laurate, cetyl 2-ethylhexarate, dioleyl adipate, diethyl adipate, diisobutyl adipate and diisodecyl adipate.

Among them, butyl stearate and butyl palmitate are particularly preferred.

The above fatty acid esters may be used singly or in combination. In addition to the above fatty acids or fatty acid esters, a lubricant of another type may be jointly contained in the magnetic layer of the invention.

Examples of such a lubricant include silicone type lubricants, fatty acid modified silicone type lubricants, fluorine type lubricants, liquid paraffines, squalane and carbon black. These may be used singly or in combination.

It is preferable for running durability of a magnetic-recording medium to be improved that a lubricant (fatty acid, ester of fatty aacid and others) used for the above-mentioned magnetic layer is used also for the conductive layer.

Binders usable in the magnetic layer are conventional thermoplastic resins, thermosetting resins, reactive resins, electron beam curable resins and mixtures thereof.

Suitable thermoplastic resins are those which have a softening point of 150° C. or less, an average molecular weight of 10,000 to 200,000 and a degree of polymerization of 200 to 2,000. Examples thereof include vinyl chloride type resins, vinyl chloride-vinyl acetate copolymers, vinyl chloride-vinylidene chloride copolymers, vinyl chloride-acrylonitrile copolymers, acrylate-acrylonitrile copolymers, acrylate-vinylidene chloride copolymers, acrylate-styrene copolymers, methacrylate-acrylonitrile copolymers, methacrylate-vinylidene chloride copolymers, methacrylate-styrene copolymers, urethane elastomers, polyvinyl chloride resins, vinylodene chloride-acrylonitrile copolymers, acrylonitrile-butadiene copolymers, polyamide resins, polyvinyl butyral resins, cellulose derivatives such as cellulose acetate butylate, cellulose diacetate, cellulose triacetate, cellulose propionate, nitrocellulose, styrene-butadiene copolymers, polyester resins, chlorovinyl ether-acrylate copolymers, amino resins, various synthetic rubber type thermoplastic resins, and mixtures thereof.

It is preferable for the binder (resin) used in the invention to be comprised of a modified resin having, as a polar group, one of $-SO_3M$, $-OSO_3M$ and $-P(=O)(OM_1)(OM_2)$ (where, M represents a hydrogen, lithium potasium or sodium atom; $M_1$ and $M_2$ each represent a hydrogen, lithium potasium or sodium atom, or an alkyl group; and $M_1$ and $M_2$ are the same with or different from each other). But such a polar group is not necessarily contained in the binder resin.

A transparent binder such as gelatin can also be used.

Suitable thermosetting resins and reactive resins are those which have a molecular weight of not more than 200,000 in a coating solution; when coated and dried, they undergo a condensation or addition reaction to form a polymer having an infinite molecular weight. Preferable ones among these resins are those which do not soften or melt before they are thermally decomposed. Typical examples thereof include phenol resins, epoxy resins, polyurethane curable resins, urea resins, melamine resins, alkyd resins, silicone resins, acrylic reactive resins, mixtures of a high molecular polyester resin and an isocyanate prepolymer, mixtures of a methacrylate copolymer and a diisocyanate prepolymer, mixtures of a polyester polyol and a polyisocyanate, urea-formaldehyde resins, mixtures of low molecular glycol/high molecular diol/triphenylmethane triisocyanate, polyamine resins and mixtures thereof.

Examples of the electron beam curable resin include unsaturated prepolymer types such as maleic anhydride type, urethane acrylic type, epoxy acrylic type, polyester acrylic type, polyether acrylic type, polyurethane acrylic type, polyamide acrylic type; and polyfunctional monomer types such as ether acrylic type, urethane acrylic type, epoxy acrylic type, phosphate acrylic type, aryl type, hydrocarbon type.

These binders are used singly or in combination, and other additives may be added when necessary.

As organic solvents used in the processes of dispersing particles, kneading and coating, there are employed, at an arbitrary rate, ketones such as acetone, methyl ethyl ketone, methyl isobutyl ketone, cyclohexanone, isophorone, tetrahydrofuran; alcohols such as methanol, ethanol, propanol, butanol, isobutanol, isopropanol, methylcyclohexanol; esters such as methyl acetate, ethyl acetate, butyl acetate, isobutyl acetate, isopropyl acetate, ethyl lactate, glycol monoethyl ether acetates; ethers such as diethyl ether, tetrahydrofuran, glycol dimethyl ethers, dioxane; tar types (aromatic hydrocarbons) such as benzene, toluene, xylene, cresol, chlorobenzene, styrene; chlorinated hydrocarbons such as methylene chloride, ethylene chloride, carbon tetrachloride, chloroform, ethylene chlorohydrin, dichlorobenzene; and N,N-dimethylformamide, hexane.

The method for kneading the components is not particularly limited, and the addition order of the components and other kneading conditions can be arbitrarily selected.

In the invention, the silver halide emulsions described in Research Disclosure No. 308119 (hereinafter abbreviated to RD308119) can be employed.

The locations of relevant descriptions are shown below.

| [Item] | [Page of RD308119] |
|---|---|
| Iodide composition | 993 I Sec. A |
| Manufacturing method | 993 I Sec. A<br>994 Sec. E |
| Crystal habit: | |
| regular crystal | 993 I Sec. A |
| twin crystal | 993 I Sec. A |
| Epitaxial | 993 I Sec. A |
| Halide composition: | |
| uniform | 993 I Sec. B |
| not uniform | 993 I Sec. B |
| Halogene conversion | 994 I Sec. C |
| Halogene displacement | 994 I Sec. C |
| Metal content | 994 I Sec. D |
| Monodispersion | 995 I Sec. F |
| Solvent addition | 995 I Sec. F |
| Latent image forming position: | |
| surface | 995 I Sec. G |
| inside | 995 I Sec. G |
| Light-sensitive materials to be applied: | |
| negatives | 995 I Sec. H |
| positives (containing internally fogged grains) | 995 I Sec. H |
| Use of mixed emulsions | 995 I Sec. J |
| Desalting | 995 II Sec. A |

In the invention, silver halide emulsions are subjected to physical ripening, chemical ripening and spectral sensitization before use. Additives used in these processes are described in Research Disclosure Nos. 17643, 18716 and 308119 (hereinafter abbreviated to RD17643, RD18716 and RD308119, respectively).

The locations of relevant descriptions are shown below.

| [Item] | [Page of RD308119] | [RD17643] | [RD18716] |
|---|---|---|---|
| Chemical sensitizers | 996 III Sec. A | 23 | 648 |
| Spectral sensitizers | 996 IV Sec. A, B, C, H, I, J | 23–24 | 648-9 |
| Supersensitizers | 996 IV Sec. A–E, J | 23–24 | 648-9 |
| Antifoggants | 998 VI | 24–25 | 649 |
| Stabilizers | 998 VI | 24–25 | 649 |

Conventional photographic additives usable in the invention are also described in the above numbers of Research Disclosure. The following are the locations of relevant descriptions.

| [Item] | [Page of RD308119] | [RD17643] | [RD18716] |
|---|---|---|---|
| Anti-color-mixing agents | 1002 VII Sec. I | 25 | 650 |
| Dye image stabilizers | 1001 VII Sec. J | 25 | |
| Whitening agents | 998 V | 24 | |
| U.V. absorbents | 1003 VIII Sec. C<br>XIII Sec. C | 25–26 | |
| Light absorbents | 1003 VIII | 25–26 | |
| Light scattering agents | 1003 VIII | | |
| Filter dyes | 1003 VIII | 25–26 | |
| Binders | 1003 IX | 26 | 651 |
| Antistatic agents | 1006 XIII | 27 | 650 |
| Hardeners | 1004 X | 26 | 651 |
| Plasticizers | 1006 XII | 27 | 650 |
| Lubricants | 1006 XII | 27 | 650 |
| Surfactants, coating aids | 1005 XI | 26–27 | 650 |
| Matting agents | 1007 XVI | | |
| Developers (contained in light-sensitive material) | 1011 XX Sec. B | | |

The invention can use various couplers, typical examples of them are exemplified in the above numbers of Research Disclosure.

The locations of relevant descriptions are as follows:

| [Item] | [Page of RD308119] | [RD17643] |
|---|---|---|
| Yellow couplers | 1001 VII Sec. D | VII Sec. C–G |
| Magenta couplers | 1001 VII Sec. D | VII Sec. C–G |
| Cyan couplers | 1001 VII Sec. D | VII Sec. C–G |
| Colored couplers | 1002 VII Sec. G | VII Sec. G |
| DIR couplers | 1001 VII Sec. F | VII Sec. F |
| BAR couplers | 1002 VII Sec. F | |
| Other useful-residue releasing couplers | 1001 VII Sec. F | |
| Alkali-soluble couplers | 1001 VII Sec. E | |

The additives usable in the invention can be added according to the methods, such as the dispersing method, described in XIV of RD30811.

In the invention, the supports shown on page 28 of RD17643, pages 647–8 of RD18716 and in XIX of RD308119 can be used.

The light-sensitive material of the invention may have various layer configurations such as normal layer order, reverse layer order, unit structure, which are exemplified in VII Sec. K of RD308119.

EXAMPLES

The present invention is hereunder described in detail with examples, but the scope of the invention is not limited to them. In the examples, part(s) means part(s) by weight.

EXAMPLE 1

Preparation of Paint A for Conductive Layer

| | |
|---|---|
| Antimony-modified $SnO_2$ (particle size: 0.3 μm) | 6 parts |
| Vinyl chloride copolymer (containing —$SO_3Na$ group) | 12 parts |
| Polyurethane resin | 8 parts |
| Myristic acid | 1 part |
| Stearic acid | 1 part |
| Butyl stearate | 1 part |
| Cyclohexanone | 60 parts |
| Methyl ethyl ketone | 120 parts |
| Toluene | 120 parts |

The above composition was thoroughly dispersed and then filtered to prepare a paint for conductive layer.

Preparation of Paint B for Magnetic Layer

| | |
|---|---|
| $\gamma$-$Fe_2O_3$ (length: 0.3 μm, width: 0.03 μm, Hc: 330) | 5 parts |
| Vinyl chloride copolymer (containing —$SO_3Na$ group) | 12 parts |
| Polyurethane resin | 8 parts |
| Myristic acid | 1 part |
| Stearic acid | 1 part |
| Cyclohexanone | 60 parts |

-continued

| | |
|---|---|
| Methyl ethyl ketone | 120 parts |
| Toluene | 120 parts |

The above composition was thoroughly dispersed with a kneader and a sand mill, then filtered to prepare a paint for magnetic layer.

A 3-μm thick magnetic layer and a 0.8-μm thick conductive layer were formed on one side of a 70-μm thick photographic PET base subjected to corona discharge, by coating paint B and paint A in this order while subjecting the coated base to an orientation treatment in the coating direction. As a result, a magnetic coating film containing approximately 2.0 mg/100 $cm^2$ of magnetic powder and approximately 1.0 mg/100 $cm^2$ of $SnO_2$ (hereunder referred to as Ex.-1) was obtained. The optical density of this magnetic coating film was 0.14.

A color photographic film was prepared by forming the following color negative emulsion layer on the reverse side of the above magnetic coating film. This photographic film was exposed, developed in a usual manner and then evaluated for the photographic property. The evaluation results were much the same as obtained with a color photographic film having no magnetic coating.

Further, the color photographic film was rubbed four times with a rubber roller in an environment of 23° C., 20% RH and then subjected to color negative development in a usual manner. No static mark was observed on the developed film. Structure of the color emulsion layer All values in the following are given in g/$cm^2$ unless otherwise indicated, except that amounts of silver halide and colloidal silver are given in amounts of silver present, and that amounts of sensitizing dye are given in moles per mole silver contained in the same layer.

| | |
|---|---|
| 1st layer: antihalation layer (HC-1) | |
| Black colloidal silver | 0.2 |
| UV absorbent (UV-1) | 0.23 |
| High boiling solvent (Oil-1) | 0.18 |
| Gelatin | 1.4 |
| 2nd layer: intermediate layer (IL-1) | |
| Gelatin | 1.3 |
| 3rd layer: low-speed red-sensitive emulsion layer (RL) | |
| Silver iodobromide emulsion (Em-1) | 1.0 |
| Sensitizing dye (SD-1) | $1.8 \times 10^{-5}$ |
| Sensitizing dye (SD-2) | $2.8 \times 10^{-4}$ |
| Sensitizing dye (SD-3) | $3.0 \times 10^{-4}$ |
| Cyan coupler (C-1) | 0.70 |
| Colored cyan coupler (CC-1) | 0.066 |
| DIR compound (D-1) | 0.03 |
| DIR compound (D-3) | 0.01 |
| High boiling solvent (Oil-1) | 0.64 |
| Gelatin | 1.2 |
| 4th layer: medium-speed red-sensitive emulsion layer (RM) | |
| Silver iodobromide emulsion (Em-2) | 0.8 |
| Sensitizing dye (SD-1) | $2.1 \times 10^{-5}$ |
| Sensitizing dye (SD-2) | $1.9 \times 10^{-4}$ |
| Sensitizing dye (SD-3) | $1.9 \times 10^{-4}$ |
| Cyan coupler (C-1) | 0.28 |
| Colored cyan coupler (CC-1) | 0.027 |
| DIR compound (D-1) | 0.01 |
| High boiling solvent (Oil-1) | 0.26 |
| Gelatin | 0.6 |
| 5th layer: high-speed red-sensitive emulsion layer (RH) | |
| Silver iodobromide emulsion (Em-3) | 1.70 |
| Sensitizing dye (SD-1) | $1.9 \times 10^{-5}$ |
| Sensitizing dye (SD-2) | $1.7 \times 10^{-4}$ |
| Sensitizing dye (SD-3) | $1.7 \times 10^{-4}$ |
| Cyan coupler (C-1) | 0.05 |
| Cyan coupler (C-2) | 0.10 |
| Colored cyan coupler (CC-1) | 0.02 |
| DIR compound (D-1) | 0.025 |
| High boiling solvent (Oil-1) | 0.17 |
| Gelatin | 1.2 |
| 6th layer: intermediate layer (IL-2) | |
| Gelatin | 0.8 |
| 7th layer: low-speed green-sensitive emulsion layer (GL) | |
| Silver iodobromide emulsion (Em-1) | 1.1 |
| Sensitizing dye (SD-4) | $6.8 \times 10^{-5}$ |
| Sensitizing dye (SD-5) | $6.2 \times 10^{-4}$ |
| Magenta coupler (M-1) | 0.54 |
| Magenta coupler (M-2) | 0.19 |
| Colored magenta coupler (CM-1) | 0.06 |
| DIR compound (D-2) | 0.017 |
| DIR compound (D-3) | 0.01 |
| High boiling solvent (Oil-2) | 0.81 |
| Gelatin | 1.8 |
| 8th layer: medium-speed green-sensitive emulsion layer (GM) | |
| Silver iodobromide emulsion (Em-2) | 0.7 |
| Sensitizing dye (SD-6) | $1.9 \times 10^{-4}$ |
| Sensitizing dye (SD-7) | $1.2 \times 10^{-4}$ |
| Sensitizing dye (SD-8) | $1.5 \times 10^{-5}$ |
| Magenta coupler (M-1) | 0.07 |
| Magenta coupler (M-2) | 0.03 |
| Colored magenta coupler (CM-1) | 0.04 |
| DIR compound (D-2) | 0.018 |
| High boiling solvent (Oil-2) | 0.30 |
| Gelatin | 0.8 |
| 9th layer: high-speed green-sensitive emulsion layer (GH) | |
| Silver iodobromide emulsion (Em-3) | 1.7 |
| Sensitizing dye (SD-6) | $1.2 \times 10^{-4}$ |
| Sensitizing dye (SD-7) | $1.0 \times 10^{-4}$ |
| Sensitizing dye (SD-8) | $3.4 \times 10^{-6}$ |
| Magenta coupler (M-1) | 0.09 |
| Magenta coupler (M-3) | 0.04 |
| Colored magenta coupler (CM-1) | 0.04 |
| High boiling solvent (Oil-2) | 0.31 |
| Gelatin | 1.2 |
| 10th layer: yellow filter layer (YC) | |
| Yellow colloidal silver | 0.05 |
| Antistain agent (SC-1) | 0.1 |
| High boiling solvent (Oil-2) | 0.13 |
| Gelatin | 0.7 |
| Formalin scavenger (HS-1) | 0.09 |
| Formalin scavenger (HS-2) | 0.07 |
| 11th layer: low-speed blue-sensitive emulsion layer (BL) | |
| Silver iodobromide emulsion (Em-1) | 0.5 |
| Silver iodobromide emulsion (Em-2) | 0.5 |
| Sensitizing dye (SD-9) | $5.2 \times 10^{-4}$ |
| Sensitizing dye (SD-10) | $1.9 \times 10^{-5}$ |
| Yellow coupler (Y-1) | 0.65 |
| Yellow coupler (Y-2) | 0.24 |
| DIR compound (D-1) | 0.03 |
| High boiling solvent (Oil-2) | 0.18 |
| Gelatin | 1.3 |
| Formalin scavenger (HS-1) | 0.08 |
| 12th layer: high-speed blue-sensitive emulsion layer (BH) | |
| Silver iodobromide emulsion (Em-4) | 1.0 |
| Sensitizing dye (SD-9) | $1.8 \times 10^{-4}$ |
| Sensitizing dye (SD-10) | $7.9 \times 10^{-5}$ |
| Yellow coupler (Y-1) | 0.15 |
| Yellow coupler (Y-2) | 0.05 |
| High boiling solvent (Oil-2) | 0.074 |
| Gelatin | 1.3 |
| Formalin scavenger (HS-1) | 0.05 |
| Formalin scavenger (HS-2) | 0.12 |
| 13th layer: 1st protective layer (Pro-1) | |
| Fine grain silver iodobromide emulsion (average grain size: 0.08 μm, AgI content: 1 mole %) | 0.4 |
| UV absorbent (UV-1) | 0.07 |

-continued

| | |
|---|---|
| UV absorbent (UV-2) | 0.10 |
| High boiling solvent (Oil-1) | 0.07 |
| High boiling solvent (Oil-2) | 0.07 |
| Formalin scavenger (HS-1) | 0.13 |
| Formalin scavenger (HS-2) | 0.37 |
| Gelatin | 1.3 |
| 14th layer: 2nd protective layer (Pro-2) | |
| Alkali-soluble matting agent (average particle size: 2 μm) | 0.13 |
| Polymethylmethacrylate (average particle size: 3 μm) | 0.02 |
| Lubricant (WAX-1) | 0.04 |
| Gelatin | 0.6 |

Besides the above composition, there were added coating aid SU-1, dispersant SU-2, antifiggants AF-1 and AF-2 having respective weight average molecular weights of 10,000 and 1,100,000, and compound DI-1 (9.4 mg/m$^2$).

C-1

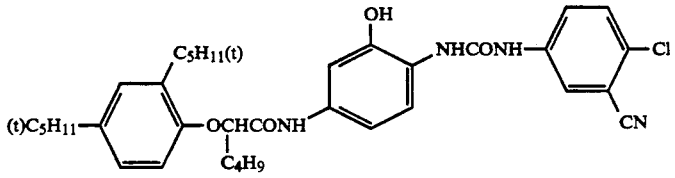

C-2

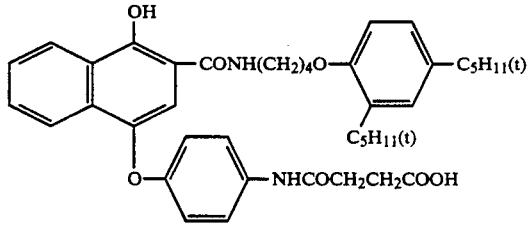

M-1

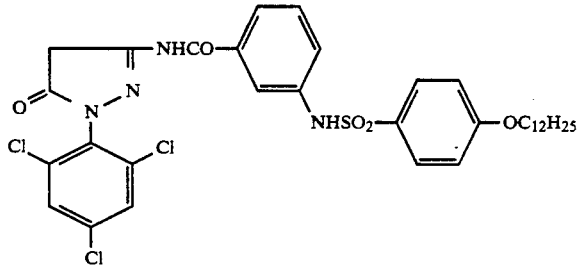

M-2

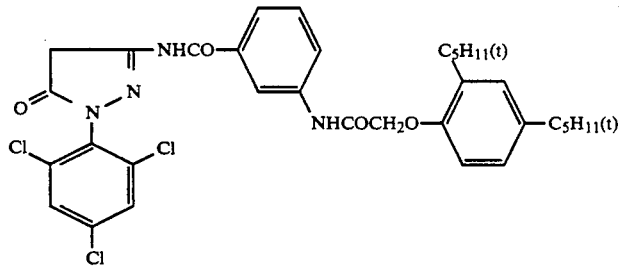

M-3

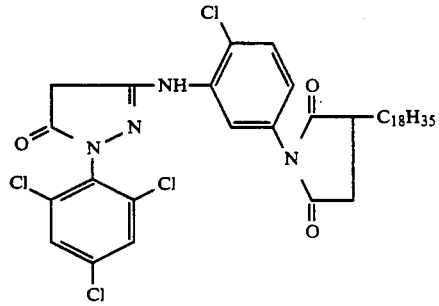

-continued
Y-1
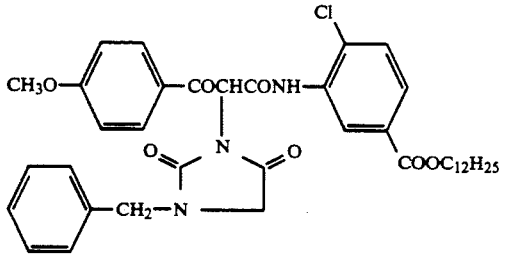
Y-2
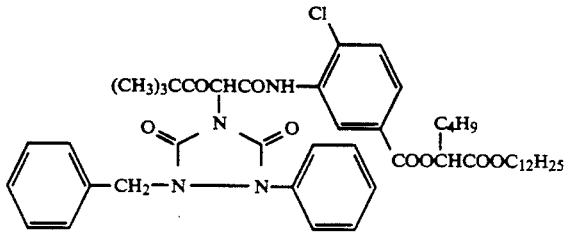
CC-1
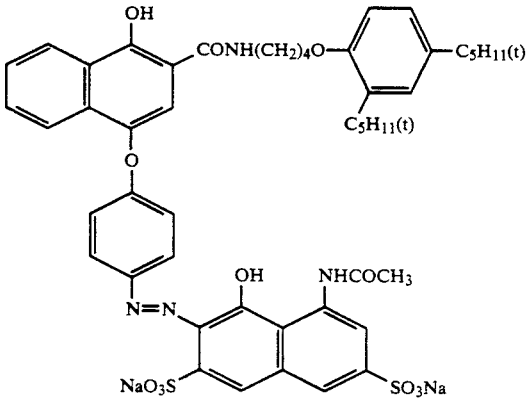
CM-1
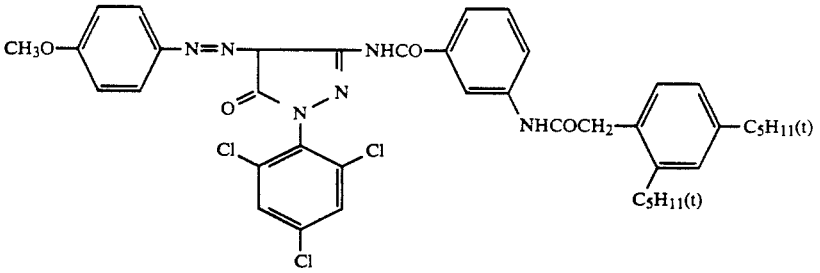
D-1
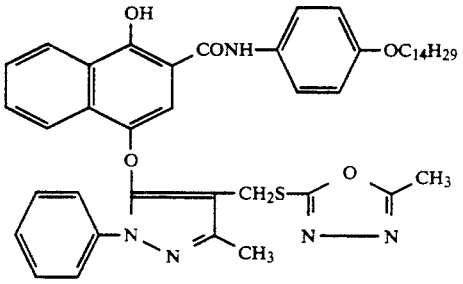

-continued
D-2
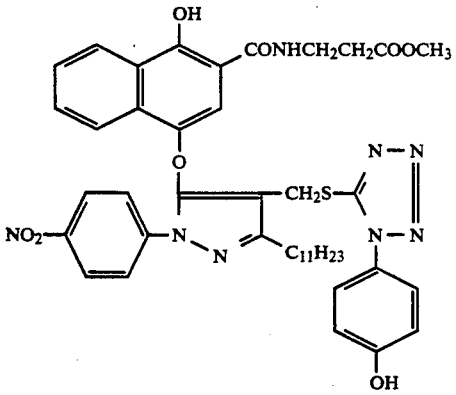
D-3
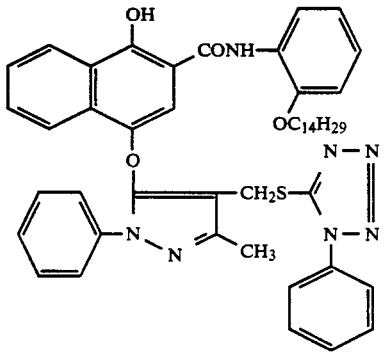
Oil-1
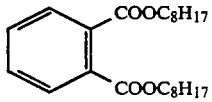
Oil-2
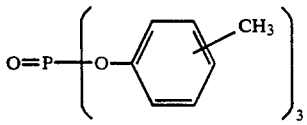
Oil-3
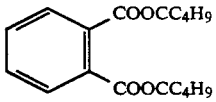
SC-1
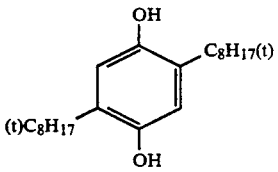
UV-1
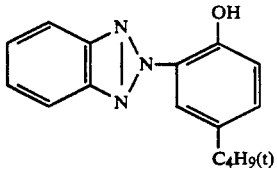
UV-2
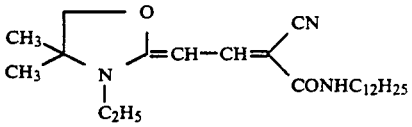

-continued
WAX-1
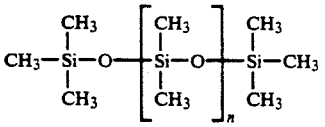
weight average molecular weight = 3,000
SU-1
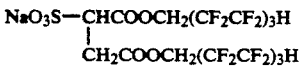
SU-2
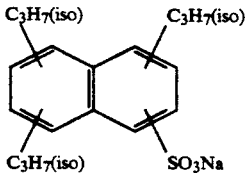
HS-1
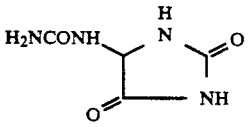
HS-2
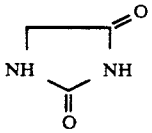
SD-1
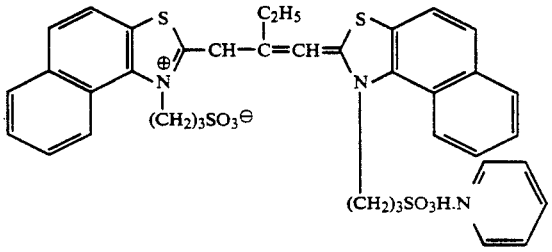
SD-2
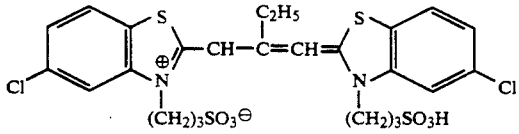
SD-3
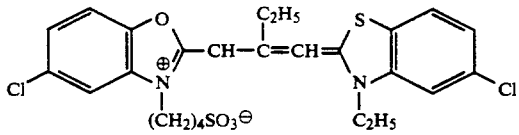
SD-4
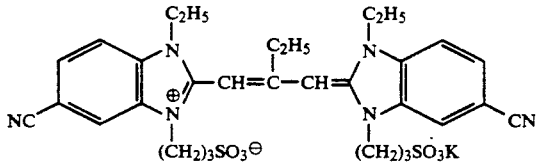
SD-6
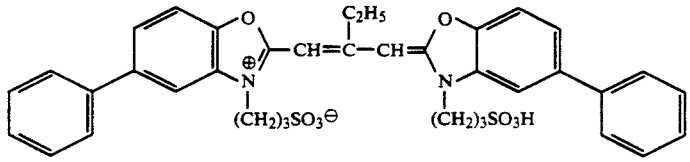

-continued
SD-7
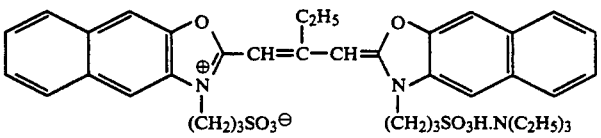
SD-8
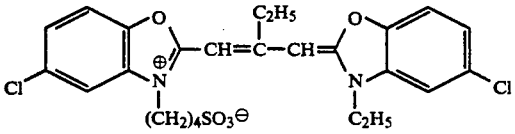
SD-9
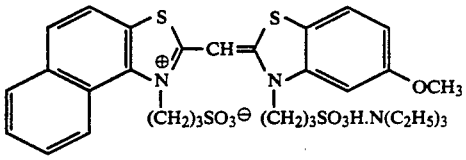
SD-10
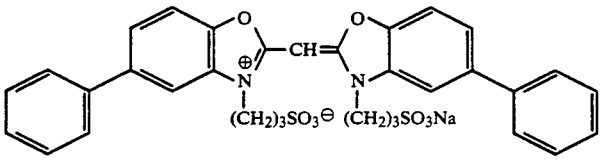
H-1
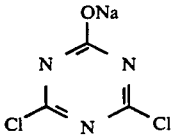
$(CH_2{=}CHSO_2CH_2)_2O$ H-2
ST-1
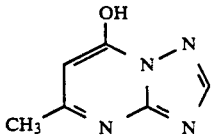
AF-1
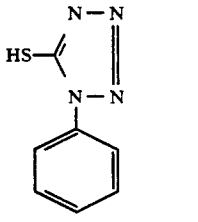
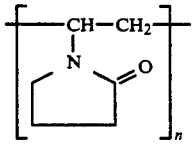
n: degree of polymerization
DI-1 (a mixture of the following three components)
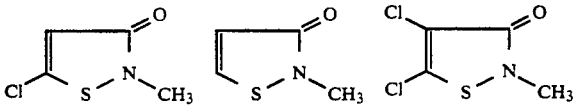

TABLE 1

| Emulsion | Average silver iodide content (%) | Average grain size (μm) | Grain form |
|---|---|---|---|
| Em-1 | 2.0 | 0.30 | Octahedron |
| Em-2 | 8.0 | 0.70 | Octahedron |
| Em-3 | 8.0 | 1.15 | Tabular twin crystal |
| Em-4 | 10.0 | 1.35 | Tabular twin crystal |

EXAMPLE 2

A magnetic coating film was formed in the same manner as in Example 1, except that 7 parts by weight of a niobium-modified $TiO_2$ (particle size: 0.4 μm) was used in place of the antimony-modified $SnO_2$ in the preparation of paint A for conductive layer. The sample prepared is referred to as Ex-2.

EXAMPLE 3

The procedure of Example 1 was repeated, except that the magnetic coating film was formed by carrying out the coating in the order of paint A and paint B. Sample Ex-3 so obtained was comprised of a 1.0-μm thick conductive layer adjacent to the base and a 2.5-μm thick magnetic layer formed on the conductive layer.

COMPARATIVE EXAMPLE 1

The procedure of Example 1 was repeated, except that the conductive layer was not formed. The sample having no conductive layer so obtained is referred to as Comp-1.

COMPARATIVE EXAMPLE 2

The procedure of Example 1 was repeated, except that the antimony-modified $SnO_2$ was not added to the conductive layer. The sample obtained is referred to as Comp-2.

EXAMPLE 4 AND EXAMPLE 5

The procedure of Example 1 was repeated, except that the magnetic coating film was formed using a paint for conductive layer which contained a vinyl chloride-vinyl acetate copolymer having no sodium sulfonate group in place of the vinyl chloride-vinyl acetate copolymer having a sodium sulfonate group. The sample obtained is referred to as Ex-5.

EXAMPLE 4

The procedure of Example 1 was repeated, except that the magnetic coating film was formed using a paint for conductive layer prepared by replacing the vinyl chloride-vinyl acetate copolymer having a sodium sulfonate group with a vinyl chloride-vinyl acetate copolymer having no sodium sulfonate group and replacing the polyurethane resin with a polyurethane resin containing $—PO_3Na_2$ groups. The sample is referred to as Ex-4.

With each of Ex-2 and Comp-1 to Comp-4, the average optical density was measured by Sakura Densitometer PDA 65 on the transmission mode, and the occurrence of static mark was checked. Further, a scratch test was carried out by scratching the backside of each film; and the load (g) under which the scratch starts occuring was measured by observing under a microscope while applying the load by the use of a needle of 1 mil (a radius of curvature at the tip of the needle is 25 μ). As the mark becomes larger, a film lowers in physical strength and becomes more liable to be scratched. The results are shown in Table 2.

TABLE 2

| Sample | Amount coated ($mg/dm^2$) Conductive oxide | Iron oxide | Average optical density | Static test | Scratch test |
|---|---|---|---|---|---|
| Ex-1 | 1.0 | 2.0 | 0.14 | No static mark | 40 g or more |
| Ex-2 | 1.2 | 2.0 | 0.13 | No static mark | 40 g or more |
| Ex-3 | 1.0 | 1.8 | 0.12 | No static mark | 40 g or more |
| Ex-4 | 1.0 | 2.0 | 0.13 | No static mark | 40 g or more |
| Ex-5 | 1.0 | 2.0 | 0.14 | No static mark | 5 g |
| Ex-6 | 1.0 | 2.0 | 0.14 | No static mark | 40 g or more |
| Comp-1 | 0 | 2.0 | 0.12 | Static marks occurred | 40 g or more |
| Comp-2 | 0 | 2.0 | 0.11 | Static marks occurred | 10 g |

What is claimed is:

1. A silver halide photographic light-sensitive material comprising;

a support having a first side and a second side which is opposite to said first side;

a silver halide emulsion layer provided on said first side; and a recording medium provided on said second side, said recording medium comprising a magnetic layer having a magnetic powder and a first binder, and a conductive layer which contains conductive particles and a second binder, at least one of said first binder and at least one of said second binder each having a polar functional group selected from the group consisting of $—SO_2M$, $—OSO_3M$ and $—P(=O)(OM_1)(OM_2)$, wherein M is hydrogen, sodium, potassium, or lithium; $M_1$ and $M_2$ are the same or different and represent hydrogen, sodium, potassium, lithium, or an alkyl group.

said conductive particles essentially consisting of one crystalline metal oxide selected from the group consisting of ZnO, $TiO_2$, $SnO_2$, $Al_2O_3$, $In_2O_3$, and $SiO_2$, and a complex oxides thereof.

2. The silver halide photographic light-sensitive material of claim 1, wherein the size of said particle is not more than 10 μm.

3. The silver halide photographic light-sensitive material of claim 1, wherein the addition amount of said particle is not more than 15 mg per 100 $cm^2$ in terms of metal oxide.

4. The silver halide photographic light-sensitive material of claim 1, wherein the optical density of said magnetic layer is not more than 1.0.

5. The silver halide photographic light-sensitive material of claim 1, wherein said magnetic powder is a ferromagnetic powder and the coating weight of said ferromagnetic powder is not more than 10 mg per 100 $cm^2$ as amount of iron present.

6. The silver halide photographic light-sensitive material of claim 1, wherein said metal oxide is one selected from the group consisting of ZnO, $TiO_2$, $SnO_2$.

7. The silver halide photographic light-sensitive material of claim 1 wherein said particle further comprises a foreign atom.

8. The silver halide photographic light-sensitive material of claim 7, wherein the amount of said foreign atom is 0.01 to 30 mol % to the amount of metal oxide.

9. The photographic material of claim 1 wherein said magnetic powder is a ferromagnetic powder containing iron, said ferromagnetic powder being present in an amount not exceeding 10 mg per 100 $cm^2$ of said magnetic layer, based on said iron.

* * * * *